US005512800A

United States Patent [19]

Omura et al.

[11] Patent Number: 5,512,800

[45] Date of Patent: Apr. 30, 1996

[54] LONG LIFE METAL HALIDE LAMP AND AN ILLUMINATION OPTICAL APPARATUS AND IMAGE DISPLAY SYSTEM USING SAME

[75] Inventors: Hideaki Omura, Ibaraki; Masayuki Wakamiya, Suita; Munehiro Tabata, Ibaraki; Nobuyoshi Takeuchi, Osaka, all of Japan

[73] Assignee: Matsushita Electric Industrial Co., Ltd., Osaka, Japan

[21] Appl. No.: 274,409

[22] Filed: Jul. 13, 1994

[30] Foreign Application Priority Data

| | | | |
|---|---|---|---|
| Jul. 13, 1993 | [JP] | Japan | 5-172789 |
| Jul. 13, 1993 | [JP] | Japan | 5-172790 |
| Sep. 7, 1993 | [JP] | Japan | 5-221611 |

[51] Int. Cl.[6] ..... H01J 17/20

[52] U.S. Cl. ..... 313/637; 313/638; 313/639; 313/640; 313/641

[58] Field of Search ..... 313/637, 638, 313/639, 640, 641

[56] References Cited

U.S. PATENT DOCUMENTS

| | | | |
|---|---|---|---|
| 3,761,758 | 9/1973 | Bamberg et al. | 313/640 |
| 3,842,307 | 10/1974 | Dobrusskin et al. . | |
| 4,686,419 | 8/1987 | Block et al. | 313/640 |
| 4,755,056 | 7/1988 | Yasuda et al. | 313/640 |
| 4,801,846 | 1/1989 | Kramer et al. | 313/640 |
| 5,220,244 | 6/1993 | Maseki et al. | 313/640 |
| 5,239,232 | 8/1993 | Heider et al. | 313/640 |
| 5,264,760 | 11/1993 | Genz et al. | 313/640 |

FOREIGN PATENT DOCUMENTS

| | | |
|---|---|---|
| 0271911 | 6/1988 | European Pat. Off. . |
| 0342762 | 11/1989 | European Pat. Off. . |
| 0453893 | 10/1991 | European Pat. Off. . |
| 0459786 | 12/1991 | European Pat. Off. . |
| 2053562 | 2/1981 | United Kingdom . |

*Primary Examiner*—Sandra L. O'Shea
*Assistant Examiner*—Vip Patel
*Attorney, Agent, or Firm*—Ratner & Prestia

[57] ABSTRACT

In a metal halide lamp container 1 sealed with mercury and rare gas, $GdX_3$, $LuX_3$, and CsX where halogen is iodine, bromine, or their mixture are sealed in a total weight of 1 mg/cc or more, with the weight of CsX defined within a range of 15% or more to 50% or less of the total halides, and the weight ratio of $GdX_3$ and $LuX_3$ is set in a range of $0.1 \leqq GdX_3/LuX_3 \leqq 10$. In addition to $GdX_3$, $LuX_3$, and CsX, at least one of thallium halide and dysprosium halide is added. Or $DyX_3$, $LuX_3$, $NdX_3$, and CsX where halogen is iodine, bromine or their mixture are sealed in the specified total weight, with the weight ratio of CsX defined in the above range.

8 Claims, 6 Drawing Sheets

LONG LIFE METAL HALIDE LAMP AND AN ILLUMINATION OPTICAL APPARATUS AND IMAGE DISPLAY SYSTEM USING SAME

BACKGROUND OF THE INVENTION

1. Field of the Invention

The present invention relates to a metal halide lamp used in general purpose illumination, optical appliances and others, an illumination optical apparatus combining a metal halide lamp and a concave reflector, and an image display system such as projection type liquid crystal display.

2. Description of the Prior Art

Recently, the metal halide lamp has been widely applied for lighting at shops, roads, and for other general purposes, and its demand is also spreading as lights for automobiles, or light source for optical appliances. An example of metal halide discharge lamp is shown below while referring to drawings.

FIG. 1 shows a structure of a single tube type metal halide lamp. In FIG. 1, numeral 1 denotes a luminous part of a discharge tube made of quartz glass, 2 is a tungsten electrode installed through a molybdenum foil 10, 3 is a sealing part tightly adhering the molybdenum foil 10, and 4 is an external lead wire.

In the metal halide lamp composed of these constituent elements, the operation is described below.

In the metal halide lamp, the metal halide added in the discharge tube together with mercury and rare gases is melted and is present as liquid phase while the lamp is lighting at the inside wall of the discharge tube. The liquid metal halide is evaporated to be gas phase, and the metal halide vapor is dissociated into metal atoms and halogen atoms in the high temperature region of the arc column. The metal atoms are excited by the arc and emit their own characteristic spectral lines. Accordingly, as compared with the high pressure mercury lamps, the metal halide lamp is superior in luminous efficacy and color rendering properties. Metal halide lamps containing metal iodides such as Tl—Na—In, Sc—Na, Dy—Tl, and Dy—Nd—Cs are widely put in practical use.

Generally, in the metal halide lamps, the luminous characteristic of the lamp is determined by the vapor pressure of the metal halides inside. So it is necessary to let the coolest-spot temperature of the discharge tube high enough to increase the vapor pressure of the metal halides in order to obtain the luminous characteristic of the metal halide additives. For this purpose, in the metal halide lamp, the tube wall load (electric power/all inner wall area) is appropriately designed to obtain the desired coolest-spot temperature. Moreover, the heat-reflecting coating is usually is applied on the outer surface of the coolest spot of the discharge tube.

In such conventional metal halide lamps, however, when the temperature of the coolest spot is raised to heighten the vapor pressure of the added metal halides and to improve the color rendering properties, the metal additives and constituent material of the discharge tube react rapidly resulting in the shortening of life caused by the drop of luminous flux or the rupture of the discharge tube.

It is known that color separation phenomenon of the arc occurs in the metal halide lamps. This phenomenon is resulted from the dependence of the emission spectrum and color on the arc position. The arc temperature is not uniform over the entire arc but is different depending on the arc position, so that the excitation state of atom or the emission from atomic species is different. The arc temperature is highest on the arc axis between two electrodes, and the arc temperature declines from the arc center to the inner wall direction of the discharge tube. For example, in the metal halide lamp filled with rare earth iodides $DyI_3$, $NdI_3$, CsI, the emissions of mercury ions and neutral atoms of Dy and Nd with a large excitation energy, are dominant in the high temperature region of the arc column. In the outer region with lower temperature, light emission from neutral atoms of Dy and Nd become dominant, and in the outermost area with even lower temperature, Cs and DyI molecules emit light mainly.

When such metal halide lamp is arranged as shown in FIG. 2 so that the arc axis may be positioned on the optical axis of the concave reflector 5 to compose an illumination optical apparatus, the color distribution of the screen 6 of an image display system is affected by the color distribution of the arc. That is, the center of the screen corresponds to the central axis of the metal halide arc, and the edge area of the screen corresponds to the outer region of the arc. The color distribution and spectral distribution of the arc from the central axis to the arc periphery correspond to the color distribution of the screen from the center toward the edge. Therefore, if the arc color separation phenomenon as mentioned above occurs in the metal halide lamp light source, there will be a large ununiformity of spectral distribution, or the color in the center and periphery of the screen. When such metal halide lamp filled with $DyI_3$, $NdI_3$, CsI is used in an illumination optical system as a light source, the screen center area of the image display system tends to be greenish and the color temperature is high, while the peripheral area of the screen tends to be reddish and the color temperature is low.

Conventionally, a technique is used to improve the uniformity of arc color by processing the outer surface of the discharge tube of the metal halide lamp in an opaque state (ground glass state) by sand blasting or similar method (hereinafter called frost processing). However, in such an optical system where the light emitted from the lamp is condensed by a concave reflector, frost processing of the outer surface of the lamp causes the apparent size of the light source to increase and therefore lowers the efficacy of the reflector. Even if the color uniformity of the screen is improved, the brightness of the screen is lowered.

SUMMARY OF THE INVENTION

It is hence a primary object of the invention to present a metal halide discharge lamp, illumination optical apparatus, and image display system which are long in life, excellent in color characteristic, high in luminous efficacy, and improved in the color separation phenomenon of arc.

A metal halide lamp of the present invention comprises, a light transparent container possessing a pair of electrodes,wherein at least gadolinium halide ($GdX_3$), lutetium halide ($LuX_3$), and cesium halide (CsX), using iodine or bromine or their mixture as halogen, are filled in said light transparent container, together with mercury and starting rare gas.

In the metal halide lamp, the total weight of the gadolinium halide, lutetium halide, and cesium halide per unit volume of the light transparent container is 1 mg/cc or more, the weight of cesium halide in the total weight of halides is 15% or more to 50% or less, and the weight ratio of gadolinium halide and lutetium halide is in a range of $0.1 \leqq GdX_3/LuX_3 < 10$.

A metal halide lamp of the present invention comprises, a light transparent container possessing a pair of electrodes, wherein gadolinium halide ($GdX_3$), lutetium halide ($LuX_3$), and cesium halide (CsX), using iodine or bromine or their mixture as halogen, are filled in said light transparent container , together with mercury and starting rare gas, moreover, at least one of dysprosium halide and thallium halide, using iodine or bromine or their mixture as halogen, is filled in said light transparent container in addition to the above halides.

In the metal halide lamp, the total weight of the halides per unit volume of the light transparent container is 1 mg/cc or more, the weight of cesium halide in the total weight of halides is 15% or more to 50% or less.

A metal halide lamp of the present invention comprises, a light transparent container possessing a pair of electrodes, wherein at least dysprosium halide ($DyX_3$), lutetium halide ($LuX_3$), neodymium halide ($NdX_3$), and cesium halide (CsX), using iodine or bromine or their mixture as halogen, are filled in said light transparent container, together with mercury and starting rare gas.

In the metal halide lamp, a lamp electric power per distance between the electrodes is 20 W/mm or more, the total weight of the dysprosium halide, lutetium halide, neodymium halide, and cesium halide per unit volume of the light transparent container is 1 mg/cc or more, the weight of cesium halide in the total weight of halides is 15% or more to 50% or less.

An illumination optical apparatus of the present invention comprises, the above mentioned metal halide lamp as light source and a concave reflector, wherein the metal halide lamp is positioned in a manner that an arc axis of the metal halide lamp is on an optical axis of the concave reflector.

A display system of the present invention comprises, the illumination optical apparatus, and an image forming unit which forms image by using the illumination optical apparatus as an light source part.

A metal halide light source excellent in luminous efficiency, luminous color characteristic, and color rendering properties is obtained, by properly choosing the kind, composition and sealing amount of metal halide, of which halogen is iodine, bromine or its mixture, and metal is gadolinium, lutetium, dysprosium, neodymium, thallium or cesium. Besides, reaction between the constituent material of discharge tube and the added metal is retarded, so that a longer life is realized. Moreover, the color separation of the arc can be significantly improved from the prior art, and when the metal halide lamp of the invention is used as the light source of the illumination optical apparatus, color uniformity of the screen can be remarkably improved.

The reason for the improvement in arc color uniformity by the invention is described below.

As mentioned above, the color separation of the arc in metal halide lamp is caused by the difference in the temperature of the arc, so the main species that emits light differs from one part to another. Even for one light emitting atomic species, as the excited level of the species varies with temperature, the wavelength of emitted light changes depending on the temperature. Generally, in high-temperature region of the arc, the intensity of the blue part of the light in the spectrum distribution which needs large excitation energy increases. On the contrary, the intensity of the red part of the spectrum distribution increases that corresponds to relatively low excitation energy. In the case dysprosium iodide is employed as one of the metal halide additives, the extent of color separation in the arc is intensified because DyI molecule emits reddish light at the outermost region of the arc where the temperature is rather low. Therefore, to improve the color distribution of the arc in the metal halide lamp, it is necessary to let the arc temperature uniform, or to choose light emitting material whose spectrum distribution has no temperature dependence. Practically, however, it is extremely difficult to make the arc temperature uniform over the entire area inside the discharge tube.

On the other hand, the spectrum distribution of lutetium, a filling material of the present invention, remains nearly constant at various arc temperatures. Lutetium radiates nearly similar emissions whether at high-temperature central region of the arc or at arc periphery with low temperature. Such characteristic phenomenon of lutetium seems to be due to the fact that the excitation energy relating to emission doesn't vary so much depending on the wavelength of the emission.

DESCRIPTION OF THE PREFERRED EMBODIMENTS

Figure 1:
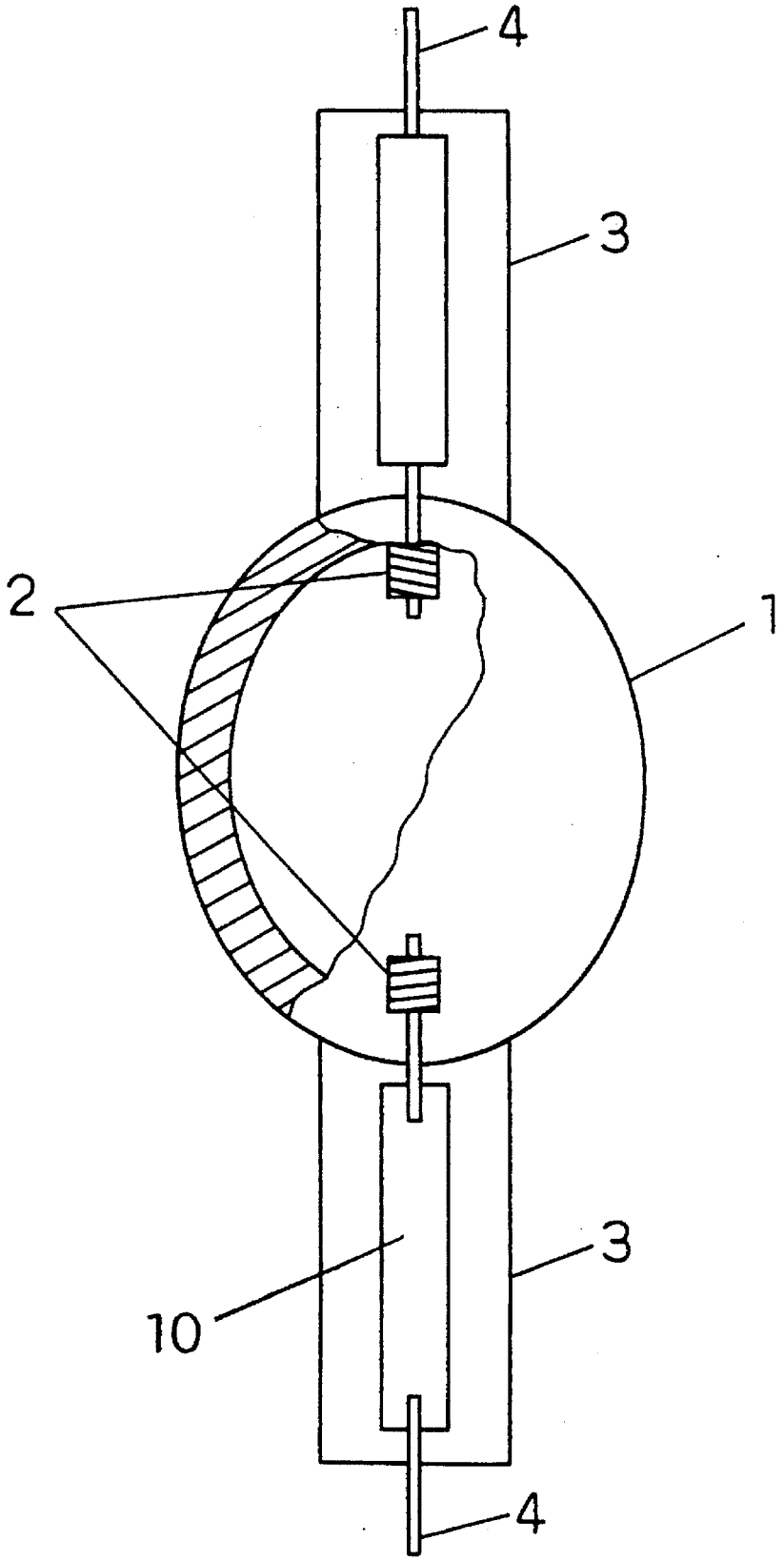
FIG. 1 is a cross-section of a discharge tube of metal halide lamp in embodiment 1 of the invention.

With referring to the drawings, a metal halide lamp in an embodiment of the invention is described below. Except for the sealed material, the structure is the same as in the prior art shown in FIG. 1, so no more explanation is made here.

The luminous part of the discharge tube 1 has nearly rotated ellipse shape, and its maximum inner diameter is 8.0 mm, and the inner volume is 0.5 cc. The distance between two electrodes, or the arc length is 6.0 mm. The discharge tube is filled with 0.5 mg of $GdI_3$, 0.2 mg of $LuI_3$, 0.3 mg of CsI, 10.0 mg of mercury as buffer gas, and 200 Torr of Ar as starting rare gas.

Figure 2:
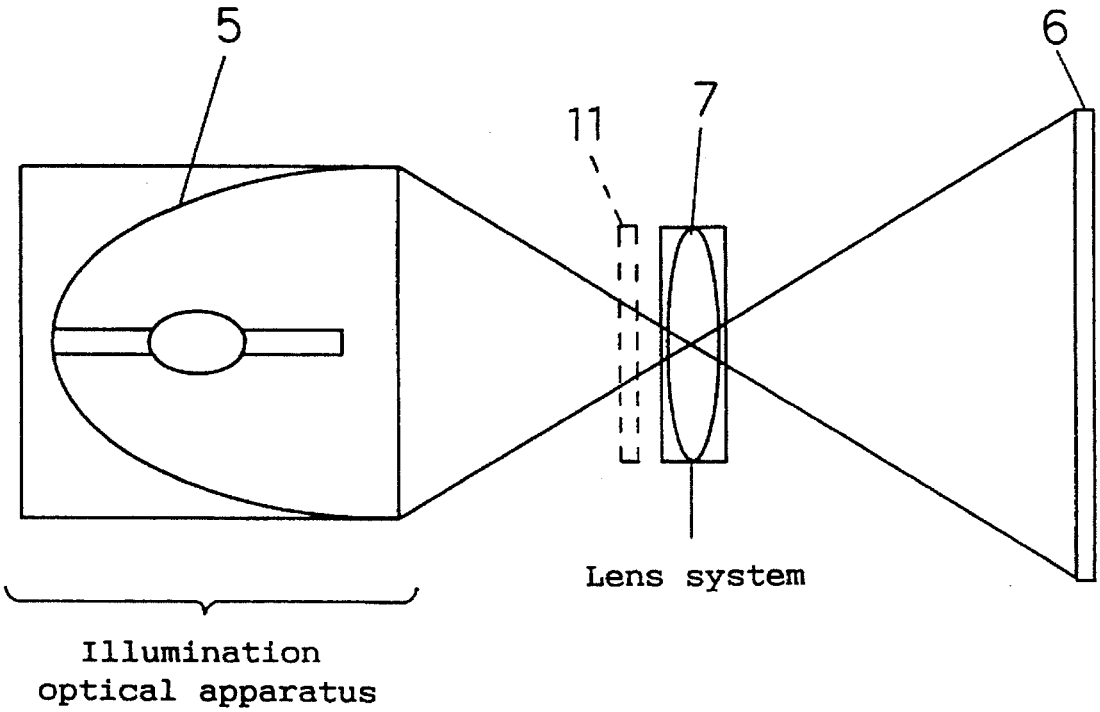
FIG. 2 is a structural diagram of an image display system using an illumination optical apparatus of embodiment 1 of the invention as a light source.

The metal halide lamp was incorporated into an image display system shown in FIG. 2, and the spectrum distribution was evaluated. Meanwhile a liquid crystal shutter driven by image signals is shown in the FIG. 2 by broken line 11. The lamp was burnt with the lamp power of 150 W, lamp voltage of 90 V, and lamp current of 1.7 A.

Numeral 5 is a concave reflector of which reflection plane is shaped parabolic or elliptical, 6 is a screen, and 7 is a projection lens system. Spectrum distribution at the center of the screen 6 is shown in curve 1 (solid line) in FIG. 3. Curve 2 (broken line) indicates the spectrum distribution of a reference lamp sealed with $DyI_3$—TlI—CsI.

Figure 3:
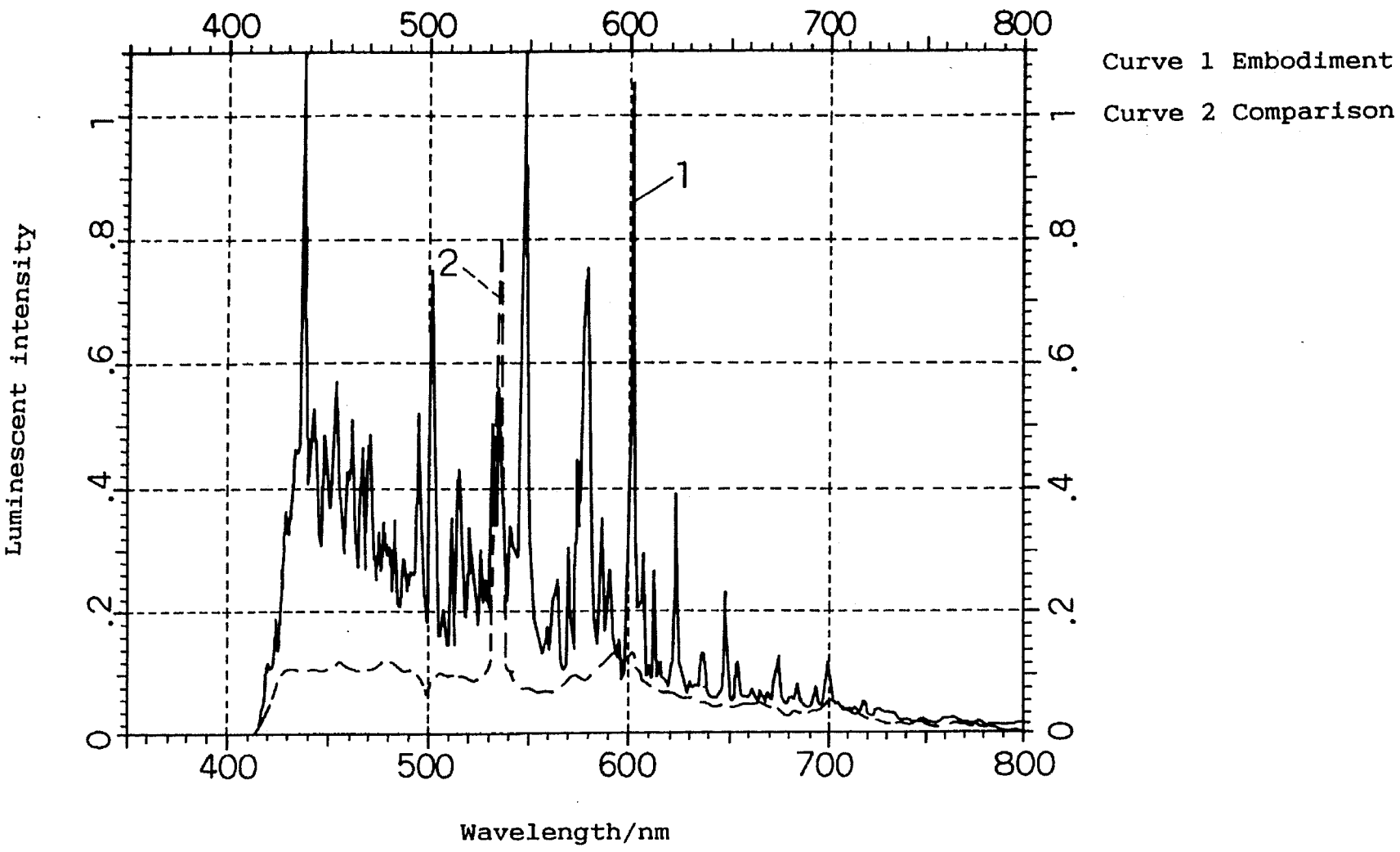
FIG. 3 is a graph showing the spectrum distribution of metal halide lamps of the prior art and embodiment 1 of the invention.

That is, in FIG. 3, curve 1 is the spectrum distribution of the lamp of the embodiment, and curve 2 is that of the $DyI_3$—TlI—CsI lamp. These two lamps were identical except for the sealed material. Comparing curve 1 and curve 2, it is clear that strong characteristic spectral lines of the sealed metal were obtained in the whole visible range, leading to notable improvement in the color rendering properties in the lamp of the invention sealed with specified amounts of $GdI_3$, LuI3, and CsI. Since the emission spectrum is distributed over the entire visible range in the metal halide lamp of the invention, the screen properties such as brightness or color is superior as compared with the conventional metal halide lamp when used as the light source for OHP or projection type liquid crystal display. Moreover, the absence of $DyI_3$ as principal component enables the lamp of the invention to be free from reddish emission region which is considered to be molecular luminescence of DyI in the peripheral area of the arc. Hence, the color uniformity of the screen is notably improved.

The total filling amount of gadolinium iodide, lutetium iodide, and cesium iodide is more than 1 mg/cc per inner volume of discharge tube in the metal halide lamp of this constitution, of which reason is as follows. The iodides are present mostly as liquid at the cooling spot during the lamp is operating, part of which evaporates to be in the discharge area as vapor. The more total amount of the iodides in the discharge tube, the more excessive liquid iodides contact with the inner wall which is at higher temperature than the coolest spot of the lamp. So, larger amount of vapor iodides can be present than before. The increase in the vapor pressure of the iodides intensifies the emission of the filled metal, which enables the color rendering properties to be improved. According to the experimental result of various filling amounts, it was found that the total sealing weight of $GdI_3$, $LuI_3$, and CsI is preferred to be greater than 1 mg/cc for practical use. However, for the rated lamp electric power of 150 W, the volume of the discharge tube is required to be 0.4 cc or larger and 2.0 cc or smaller. If the volume is smaller than 0.4 cc, the liquid iodides deposit on the entire inner surface of the tube during the lamp in operating, causing the luminance to be lowered significantly. When the inner volume is bigger than 2.0 cc, as the area with lowest temperature spreads the iodides must be further increased.

The weight ratio of $GdI_3/LuI_3$ should not be less than 0.1, because the luminance of the arc and the emission efficiency drops. In the case weight ratio of $GdI_3/LuI_3$ is larger than 10, characteristic spectral lines from rare earth metals becomes weakened, instead, the emission from mercury is enhanced ,causing the color rendering properties to be worsened.

Cesium iodide is effective to stabilize the arc discharge and to increase the vapor pressure of $GdI_3$ and $LuI_3$. In addition to the flattening of the arc, cesium iodide make it possible to obtain desirable emission spectrum by forming complex iodides such as $GdCsI_4$ with high vapor pressure. But excessive CsI lowers the luminance of the lamp by depositing on the inner surface of the discharge tube. Experimental result shows cesium iodide is required to be in a range of 15% to 50% of the total weight of iodides for practical purpose.

After 3,000-hour life test of the metal halide lamp of the invention, there was no rupture or leak, and the degree of devitrification was confirmed to be small.

A metal halide lamp in the second embodiment is described below. Except for the sealed material, the structure is the same as in the prior art shown in FIG. 1, so no more explanation is made here. The luminous part of the discharge tube 1 has nearly rotated ellipse shape, and its maximum inner diameter is 8.0 mm, and the volume is 0.5 cc. The distance between the electrodes, or the arc length is 5.5 mm. The discharge tube is filled with 0.3 mg of $GdI_3$, 0.2 mg of $LuI_3$, 0.1 mg of TlI, 0.3 mg of CsI, 10.0 mg of mercury as buffer gas, and 200 Torr of Ar as starting rare gas.

The metal halide lamp was incorporated into an optical system shown in FIG. 2, and the spectrum distribution and illuminance were evaluated. The lamp was burnt at the lamp electric power of 150 W, lamp voltage of 90 V, and lamp current of 1.7 A.

Numeral 5 is a concave reflector, 6 is a screen, and 7 is a projection lens system. The spectrum distribution and illuminance of the screen were measured by scanning photosensors along the diagonal line of the screen. The spectrum distribution was converted to the color temperature. The distribution of color temperature and illuminance on the screen is indicated by solid line in FIG. 4. Similar measurement was conducted for the conventional lamp sealed with 0.5 mg of $DyI_3$, 0.2 mg of $NdI_3$, and 0.3 mg of CsI for comparison and the results are shown by broken line in FIG. 4. The circled lines correspond to the graph axis indicated by the arrow.

Figure 4:
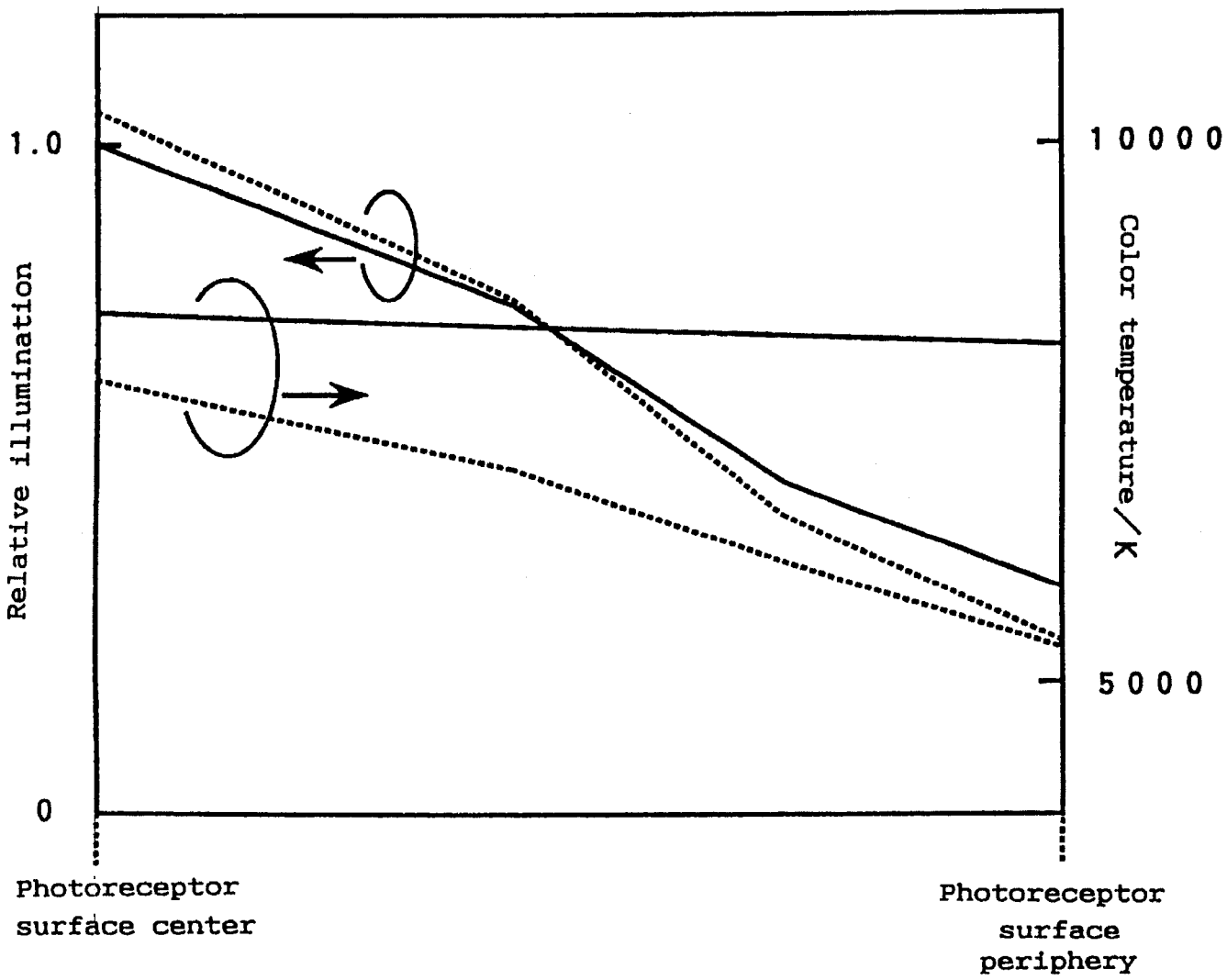
FIG. 4 is a graph showing distribution of color temperature and illuminance of a screen in embodiment 2 of the invention.

In FIG. 4 the solid line shows the color temperature distribution and illuminance distribution of the lamp of the embodiment, and the broken line represents those of the $DyI_3$—$NdI_3$—CsI lamp fabricated for contrast. These two lamps were identical except for the metal halide additives.

As can be seen from FIG. 4, the lamp filled with metal halides of the embodiment has nearly the equivalent brightness of the conventional $DyI_3$—$NdI_3$—CsI lamp, that is, the illumination and its distribution of the screen is mostly the same. Color temperature of the screen with the lamp of the embodiment is slightly higher than the conventional one. But the color temperature uniformity of the screen with the lamp of the embodiment is greatly different from that with the conventional lamp. Difference of color temperature between the center and the edge of the screen decreased from 1400K to 300K in this embodiment, and the color uniformity of the screen is notably improved. This is because there is almost no reddish luminescent region due to the molecular luminescence in the periphery of the arc. Hitherto, the color difference in the arc of metal halide lamp was a serious problem when it is used as the light source for OHP or liquid crystal projector because the color difference results in the ununiformity of the screen. This problem is largely improved with this invention.

In the metal halide lamp of this constitution, the total filling weight of gadolinium iodide, lutetium iodide, thallium iodide and cesium iodide must be 1 mg/cc or more per unit volume of the discharge tube with the same reason as mentioned in embodiment 1.

The weight of cesium iodide was also found to be required in a range of 15% to 50% of the total weight of iodides sealed in the discharge tube same as in embodiment 1.

Figure 5:
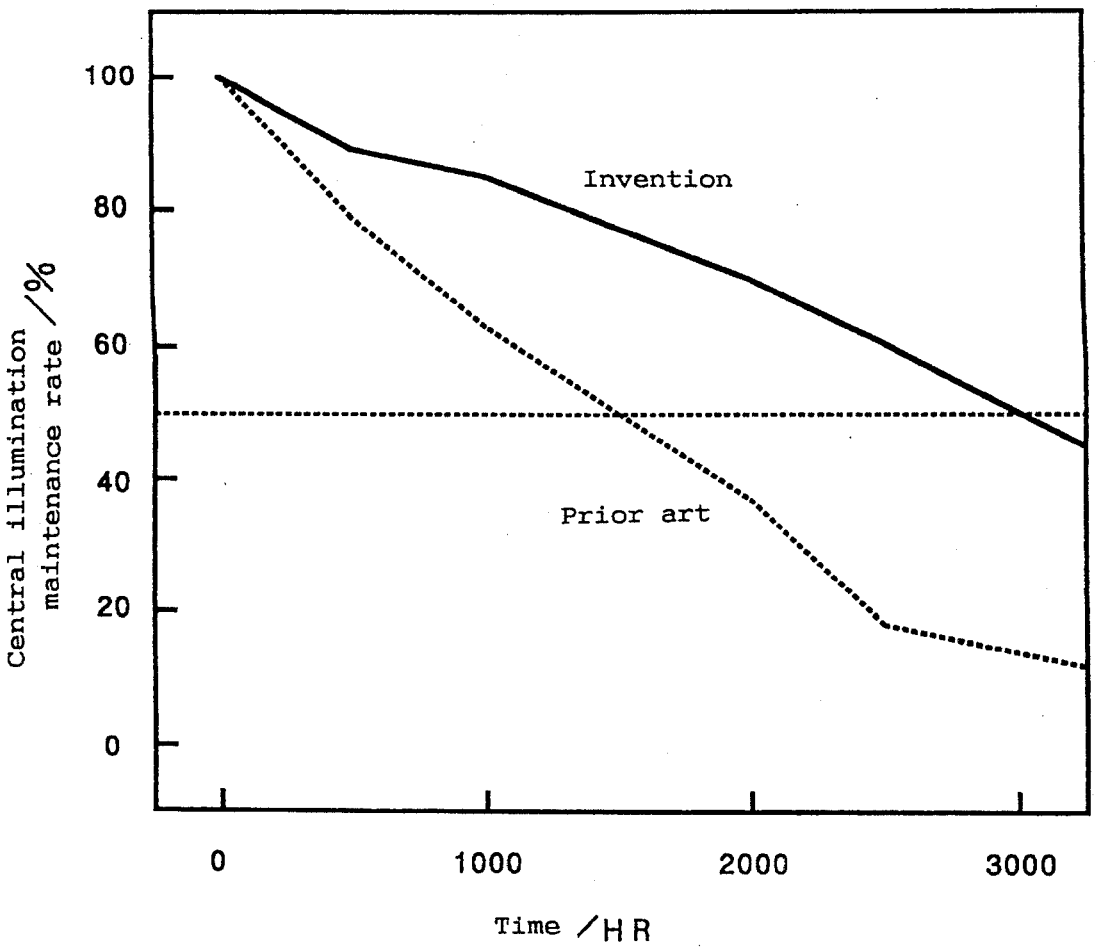
FIG. 5 is a graph showing results of the life test on the lamp in embodiment 2 of the invention.

The life test of the metal halide lamp in the embodiment and the conventional one was conducted in the optical system shown in FIG. 2. Illuminance maintenance rate with time of the two lamps at the center of the screen is shown in FIG. 5.

The lamp of the embodiment indicated by solid line was superior in the illuminance maintenance rate. Time to be 50% of the initial level was 3,000 hours, about twice as long as for the conventional lamp (indicated by broken line). Examining the lamp after life test, the extent of devitrification in the lamp of the embodiment was extremely small in as compared with the conventional lamp, and there was no rupture or leak even after 5,000 hours.

A metal halide lamp in the third embodiment is described below. Except for the sealed material, the structure is the same as in the prior art shown in FIG. 1 so no more explanation is made here.

The luminous part of the discharge tube 1 has nearly rotated ellipse shape, and its maximum inner diameter is 8.0 mm, and the inner volume is 0.5 cc. The distance between electrodes, or the arc length is 5.0 mm. The discharge tube is filled with 0.5 mg of $DyI_3$, 0.5 mg of $LuI_3$, 0.5 mg of $NdI_3$, 0.4 mg of CsI, 10.0 mg of mercury as buffer gas, and 200 Torr of Ar as starting rare gas.

The metal halide lamp was incorporated into an illumination optical apparatus shown in FIG. 2 after combined with a concave reflector 5. An image display apparatus was made up using this illumination optical apparatus as its light source part, and the emission spectrum of the lamp was evaluated. The distribution at various position on the screen was measured to calculate the color temperature of those points by scanning the photosensor along the diagonal of the screen from the center to the periphery. The lamp was operated at the lamp power of 150 W, lamp voltage of 90 V, and lamp current of 1.7 A.

Figure 6:
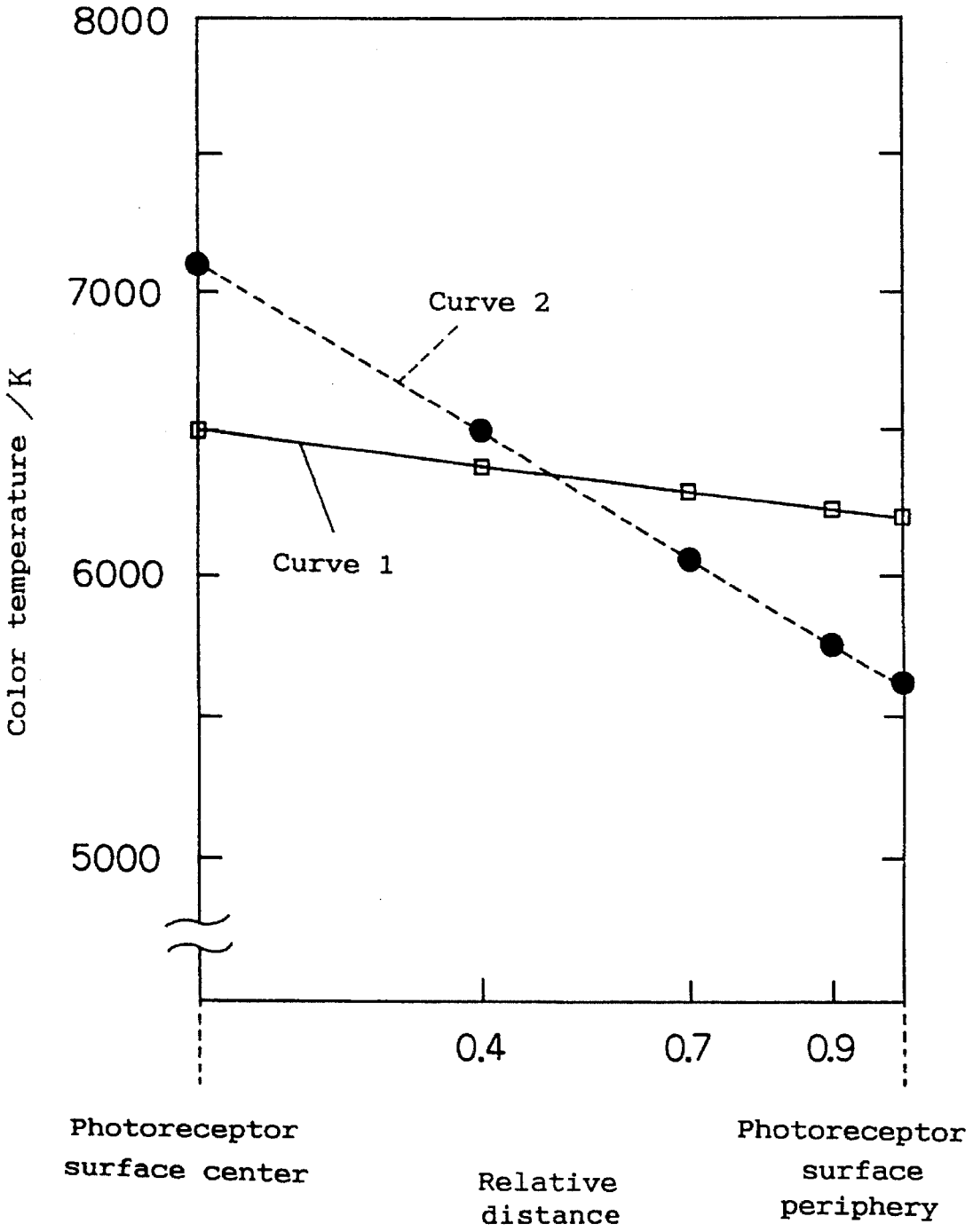
FIG. 6 is the color temperature distribution of the screen with the lamp in embodiment 3 of the invention.

Color temperature distribution of the screen are illustrated in FIG. 6 with the similar measurement for results the lamp sealed with 0.8 mg of $DyI_3$, 0.4 mg of $NdI_3$, and 0.7 mg of CsI.

In FIG. 6, curve 1 denotes the color temperature distribution on the screen with the lamp of the embodiment, and curve 2 is that for the $DyI_3$—$NdI_3$—CsI lamp fabricated for comparison. FIG. 6 is the graph of color temperature versus relative distance from the screen center, being the screen edge set to 1. These two lamps were identical except for the sealed material. In the case with the conventional lamp sealed with $DyI_3$, $NdI_3$, and CsI, the color temperature of the center and periphery on the screen was 7100K and 5600K, respectively so and the difference between the center and edge was 1500K. And in the case with the lamp of the invention embodiment sealed with specified amounts of $DyI_3$, $LuI_3$, $NdI_3$, and CsI, the color temperature of the screen center was 6500K, and the peripheral color temperature was 6200K, so the difference was as small as 300K. The uniformity of color temperature distribution on the screen was substantially improved. The brightness of the screen was exactly the same either at the center or the periphery in both lamps.

Moreover, with the embodiment of the invention, there was no reddish luminescent region estimated to be due to molecular emission of DyI which occurred in low temperature area in the conventional arc periphery. Instead, emission from lutetium was observed, of which spectrum distribution, that is, color is similar both at arc center and arc periphery.

There was no problem practically as far as the total sealing weight of $DyI_3$, $LuI_3$, $NdI_3$, and CsI was not less than 1 mg/cc same as in embodiments 1 and 2. However, for the rated lamp electric power of 150 W, the volume of discharge tube must be 0.4 cc or larger to 2.0 cc or smaller. If the volume is smaller than 0.4 cc, the liquid iodides deposit on the entire inner surface of the tube during the lamp is operating, which leads to the significant decrease in brightness. When the inner volume is larger than 2.0 cc, the area of the lowest temperature spreads, and hence larger amount of iodides becomes necessary. It was found the weight of the cesium iodide is required to be 15% or more and 50% or less of the total iodides weight filled in the discharge tube same as in embodiments 1 and 2.

According to the life test result of the metal halide lamp of the embodiment of the invention, there was no breakage or leak after 3,000 hours, and the degree of devitrification was smaller than in the prior art.

In this embodiment, an experiment on the lamp electric power was conducted, and it became clear that the effect of the invention is largest if the power lays in the following range. That is, the lamp electric power per distance between electrodes should be 20 W/mm or more. If the lamp electric power per distance between electrodes is small than 20 W/mm, the coldest temperature in the lamp decreases so that sufficient metal halide vapor pressure cannot be obtained. To the contrary, lamp electric power per arc length larger than 60/mm, make the lamp temperature climb up so much extent that the lamp life is shortened.

In the foregoing embodiments, iodides were halides, but same effects of the invention were confirmed for bromides or mixture of iodides and bromides.

In the embodiments mentioned above, the effects of the invention were confirmed for the metal halide lamps of single tube structure without outer tube, but the effects of the invention are not limited to the single tube structure, but are also confirmed for the metal halide lamp in the structure with an outer tube.

What is claimed is:

1. A metal halide lamp comprising:

a light transparent container possessing a pair of electrodes, and a fill material sealed in said light transparent container, wherein said fill material consists essentially of:

gadolinium halide ($GdX_3$), lutetium halide ($LuX_3$), and cesium halide (CsX), using iodine or bromine or their mixture as halogen, together with mercury and starting rare gas.

2. A metal halide lamp comprising:

a light transparent container possessing a pair of electrodes, wherein at least gadolinium halide ($GdX_3$), lutetium halide ($LuX_3$), and cesium halide (CsX), using iodine or bromine or their mixture as halogen, are sealed in said light transparent container, together with mercury and starting rare gas; and wherein the total weight of the gadolinium halide, lutetium halide, and cesium halide per unit volume of the light transparent container is 1 mg/cc or more, the weight of cesium halide in the total weight of halides is 15–50 percent, and the weight ratio of gadolinium halide and lutetium halide is in a range of $0.1 \leqq GdX_3/LuX_3 \leqq 10$.

3. A metal halide lamp comprising:

a light transparent container possessing a pair of electrodes, and a fill material sealed in said light transparent container, wherein said fill material consists essentially of:

gadolinium halide ($GdX_3$), lutetium halide ($LuX_3$), and cesium halide (CsX), using iodine or bromine or their mixture as halogen, together with mercury and starting rare gas, and at least one of dysprosium halide and thallium halide, using iodine or bromine or their mixture as halogen.

4. A metal halide lamp comprising:

a light transparent container possessing a pair of electrodes, wherein gadolinium halide ($GdX_3$), lutetium halide ($LuX_3$), and cesium halide (CsX), using iodine or bromine or their mixture as halogen, are sealed in said light transparent container, together with mercury and starting rare gas, and at least one of dysprosium halide and thallium halide, using iodine or bromine or their mixture as haligen, is sealed in said light transparent container in addition to the above halides; and wherein the total weight of the halides per unit volume of the light transparent container is 1 mg/cc or more, the weight of cesium halide in the total weight of halides is 15–50 percent.

5. A metal halide lamp comprising:

a light transparent container possessing a pair of electrodes, and a fill material sealed in said light transparent container, wherein said fill material consists essentially of dysprosium halide ($DyX_3$), lutetium halide ($LuX_3$), neodymium halide ($NdX_3$), and cesium halide (CsX), using iodine or bromine or their mixture as halogen, together with mercury and starting rare gas.

6. A metal halide lamp comprising;

a light transparent container possessing a pair of electrodes, wherein at least dysprosium halide ($DyX_3$), lutetium halide ($LuX_3$), neodymium halide ($NdX_3$), and cesium halide (CsX), using iodine or bromine or their mixture as halogen, are sealed in said light transparent container, together with mercury and starting rare gas; and wherein a lamp electric power per distance between the electrodes is 20 W/mm or more, the total weight of the dysprosium halide, lutetium halide, neodymium halide, and cesium halide per unit volume of the light transparent container is 1 mg/cc or more, the weight of cesium halide in the total weight of halides is 15–50 percent.

7. An illumination optical apparatus comprising:

a metal halide lamp as claimed in claim 1, 2, 3, 4, 5, or 6 as a light source, and a concave reflector, wherein the metal halide lamp is positioned in a manner that an arc axis of the metal halide lamp is on an optical axis of the concave reflector.

8. A display system comprising:

the illumination optical apparatus of claim 7, and an image forming unit which forms an image by using the illumination optical apparatus as a light source, the image forming unit having a screen on which the image is formed, and a lens system through which light from the illumination optical apparatus is focused on the screen.

* * * * *

UNITED STATES PATENT AND TRADE MARK OFFICE

CERTIFICATE OF CORRECTION

PATENT NO. : 5,512,800
DATED : April 30, 1996
INVENTOR(S) : Omura et al.

It is certified that error appears in the above-identified patent and that said Letters Patent is hereby corrected as shown below:

Column 9, line 14, the word "haligen" should be --halogen--.

Signed and Sealed this

Twenty-second Day of October, 1996

*Attest:*

Bruce Lehman

BRUCE LEHMAN

*Attesting Officer*

*Commissioner of Patents and Trademarks*